US008801397B2

(12) United States Patent
Okaichi et al.

(10) Patent No.: US 8,801,397 B2
(45) Date of Patent: Aug. 12, 2014

(54) COMPRESSOR

(75) Inventors: Atsuo Okaichi, Osaka (JP); Fuminori Sakima, Osaka (JP); Osamu Ogawa, Kyoto (JP)

(73) Assignee: Panasonic Corporation, Osaka (JP)

( * ) Notice: Subject to any disclaimer, the term of this patent is extended or adjusted under 35 U.S.C. 154(b) by 97 days.

(21) Appl. No.: 13/499,120

(22) PCT Filed: Oct. 13, 2010

(86) PCT No.: PCT/JP2010/006090

§ 371 (c)(1), (2), (4) Date: Mar. 29, 2012

(87) PCT Pub. No.: WO2011/045928

PCT Pub. Date: Apr. 21, 2011

(65) Prior Publication Data

US 2012/0189470 A1 Jul. 26, 2012

(30) Foreign Application Priority Data

Oct. 14, 2009 (JP) ..... 2009-236930

(51) Int. Cl.
*F04C 29/02* (2006.01)

(52) U.S. Cl.
USPC ..... 417/366; 417/372; 417/410.3

(58) Field of Classification Search
USPC ..... 417/366, 372, 410.3, 902; 418/102
See application file for complete search history.

(56) References Cited

U.S. PATENT DOCUMENTS

| | | | | |
|---|---|---|---|---|
| 2007/0154334 | A1 | 7/2007 | Amano | |
| 2007/0217936 | A1 | 9/2007 | Oh et al. | |
| 2009/0293534 | A1 * | 12/2009 | Tanaka | 62/470 |

FOREIGN PATENT DOCUMENTS

| | | | | |
|---|---|---|---|---|
| CN | 2811623 Y | | 8/2006 | |
| CN | 1880770 | | 12/2006 | |
| CN | 101037995 | | 9/2007 | |
| CN | 101205915 | | 6/2008 | |
| CN | 101457753 | | 6/2009 | |
| CN | 101469714 | | 7/2009 | |
| EP | 1 477 670 | | 11/2004 | |
| JP | 50-017057 | | 5/1975 | |
| JP | 54-137912 | | 9/1979 | |
| JP | 55-165981 | | 11/1980 | |
| JP | 58-053879 | | 4/1983 | |
| JP | 61-088081 | | 6/1986 | |
| JP | 62-126581 | | 8/1987 | |
| JP | 2-107783 | * | 8/1990 | F04C 29/02 |
| JP | 3-032191 | | 3/1991 | |
| JP | 4-325795 | | 11/1992 | |
| JP | 60-164692 | | 8/1995 | |
| JP | 8-028476 | | 1/1996 | |
| JP | 11-117882 | | 4/1999 | |
| JP | 2005-220829 | | 8/2005 | |
| JP | 2006-283592 | | 10/2006 | |
| JP | 2007-187008 | * | 7/2007 | F04B 39/04 |
| JP | 2009-228668 | | 10/2009 | |

* cited by examiner

*Primary Examiner* — Bryan Lettman
(74) *Attorney, Agent, or Firm* — Hamre, Schumann, Mueller & Larson, P.C.

(57) ABSTRACT

A compressor (100) includes a closed casing (101), a compression mechanism (120), a motor (130) and an oil separating member (17A). The oil separating member (17A) rotates together with a shaft (140). The oil separating member (17A) has a peripheral wall (173) and a bottom wall (175) that form a recess (171). An inlet of a discharge pipe (160) penetrating the closed casing (101) is located in the recess (171). A plurality of oil expelling ports (174) are provided in the peripheral wall (173) of the oil separating member (17A) so as to be scattered.

12 Claims, 10 Drawing Sheets

FIG.6

Effect of reducing the amount of oil discharge achieved by the oil separation member of Embodiment 1

| | Without the oil separating member | With the oil separating member |
|---|---|---|
| Amount of oil discharge | 100% | 11% |

COMPRESSOR

TECHNICAL FIELD

The present invention relates to a compressor that separates, inside thereof, an oil from a working fluid and that is used for air-conditioners, heat pump water heaters, heat pump heaters, refrigerators, automotive air-conditioners, etc.

BACKGROUND ART

Conventionally, there has been known a compressor having a configuration in which a compression mechanism and a motor are disposed in a closed casing, and a working fluid (a refrigerant, for example) discharged from the compression mechanism to an internal space of the closed casing is expelled from the compressor through a discharge pipe. In such a compressor, an oil separating member for separating, by utilizing a centrifugal force, an oil from the working fluid being guided to the discharge pipe is used to suppress exit of the oil through the discharge pipe together with the working fluid. For example, Patent Literature 1 discloses a compressor 500 as shown in FIG. 9.

The compressor 500 includes a compression mechanism 503 that is disposed at a lower position in a closed casing 501 and discharges a working fluid to an internal space of the closed casing 501 through an outside pipe 502, and a motor 520 disposed above the compression mechanism 503. A discharge pipe 530 is provided at an upper center of the closed casing 501 so as to penetrate the closed casing 501. An oil separating member 510 is fixed to an upper part of a rotor 521 of the motor 520.

The oil separating member 510 is composed of a flat rotational plate 513, and a conical tube 512 extending upward from an upper face of the rotational plate 513 while contracting radially. That is, the rotational plate 513 and the conical tube 512 form a recess that opens while narrowing upward so as to have an opening smaller than its bottom face. The working fluid flows into the recess through the opening. An inlet that is a lower opening of the discharge pipe 530 is located in the recess. When the oil separating member 510 with the inlet of the discharge pipe 530 being located therein rotates synchronously with the rotor 521, a rotational speed component is given to the working fluid inside the conical tube 512, and thereby oil droplets floating in the working fluid are separated centrifugally. The oil separated from the working fluid lands on an inner wall surface of the conical tube 512 and is guided toward the rotational plate 513 along the inclination of the inner wall surface. Then, the oil is expelled to the outside of the conical tube 512 through an oil release hole 515 provided at a lower end of the conical tube 512.

However, in the conventional configuration shown in Patent Literature 1, since the conical tube 512 is widened downward, the separated oil is guided toward the rotational plate 513 that makes a dead end. Thus, in the case where the oil release hole 515 is too small, the pressure loss in expelling the oil is increased and the oil accumulates on the rotational plate 513 near the inlet of the discharge pipe 530. As a result, the flow of the working fluid picks up the oil again in the working fluid, and the picked-up oil is discharged through the discharge pipe 530. On the other hand, in the case where the oil release hole 515 is too large, the oil separated inside the conical tube 512 cannot close completely the oil release hole 515, and thus the working fluid containing oil droplets shortcuts through the oil release hole 515 and flows into the vicinity of the discharge pipe 530 inside the conical tube 512. As a result, the oil droplets cannot be separated completely from the working fluid being guided to the discharge pipe 530, and thus a large amount of oil is discharged through the discharge pipe 530.

The above-mentioned problems are caused by the shape of the oil separating member in which the recess formed inside thereof has an opening smaller than its bottom face. Therefore, such problems do not arise when the shape of the oil separating member is designed so that the recess formed inside the oil separating member has an opening with a size equal to or larger than the size of its bottom face. For example, Patent Literature 2 discloses a compressor 600 as shown in FIG. 10.

The compressor 600 includes a closed casing 601, a compression mechanism 602, a motor 620 and a discharge pipe 630 like the compressor 500 shown in FIG. 9. An oil separating member 610 in the compressor 600 is in the shape of a saucer. The oil separating member 610 has a bottom wall 617 and a peripheral wall 618. The bottom wall 617 is sandwiched between an end ring 622 and a balance weight 623 so as to be fixed above a rotor 621. The peripheral wall 618 extends upward from a periphery of the bottom wall 617, vertically up to a certain height and expanding therefrom. Furthermore, the discharge pipe 630 has an inlet located in the vicinity of the bottom wall 617 of the saucer-shaped oil separating member 610. The end ring 622 and the bottom wall 617 close an upper end of an oil supply channel 605 penetrating a shaft 603 axially. When the rotation of the rotor 621 rotates the integrally-fixed oil separating member 610, a speed component in the rotational direction is given to the working fluid on an inner side of the peripheral wall 618, and thereby oil droplets floating in the working fluid are separated centrifugally. The oil separated from the working fluid lands on an inner wall surface of the peripheral wall 618 and is guided upward along the inclination of the inner wall surface. Then, the oil is splattered radially outward from an upper end of the peripheral wall 618 by a centrifugal force.

CITATION LIST

Patent Literature

PTL 1: JP 54(1979)-137912 U
PTL 2: JP 62(1987)-126581 U

SUMMARY OF INVENTION

Technical Problem

In the conventional configuration shown in Patent Literature 2, the centrifugally-separated oil is guided to the upper end by the inclination of the inner wall surface of the peripheral wall 618, so that the oil is expelled from the inside to the outside of the oil separating member 610. However, there is a problem in that the direction in which the oil is expelled is opposed to the direction in which the working fluid flows and thus the oil separation efficiency is lowered. This is because the oil flowing upward forms an oil slick with a certain thickness on the inner wall surface of the peripheral wall 618, and the flow of the working fluid flowing downward picks up the oil again from the surface of the oil slick into the working fluid.

The present invention has been accomplished to solve the above-mentioned conventional problems. The present invention is intended to provide a compressor capable of reducing the amount of oil discharged through a discharge pipe.

Solution to Problem

In order to solve the conventional problems, the present invention provides a compressor including: a closed casing; a compression mechanism disposed in the closed casing so as to compress a working fluid and discharge the working fluid to an internal space of the closed casing; a motor disposed in the closed casing so as to drive the compression mechanism via a shaft; an oil separating member having a peripheral wall and a bottom wall that form a recess that opens, in a direction leading away from the shaft, with a size equal to or larger than a bottom face of the recess, the oil separating member being configured to rotate together with the shaft; and a discharge pipe penetrating the closed casing and having an inlet that opens toward the bottom wall in the recess. A plurality of oil expelling ports are provided in the peripheral wall of the oil separating member so as to be scattered in a circumferential direction of the peripheral wall and an axial direction of the shaft.

This configuration allows the peripheral wall to transfer the rotation of the shaft to the working fluid on an inner side of the peripheral wall, and thus a flow of the working fluid having a large speed component in the rotational direction is induced on the inner side of the peripheral wall. Accordingly, a centrifugal force surely acts on the working fluid being guided to the inlet of the discharge pipe located on the inner side of the peripheral wall and on the oil droplets floating in the working fluid. Thereby, the oil droplets collide with the inner wall surface of the peripheral wall located on the outer circumferential side, so that the oil can be separated from the working fluid. Furthermore, the oil expelling ports provided in the peripheral wall make it possible to expel, by utilizing a centrifugal force, the separated oil to an outer side of the peripheral wall through the oil expelling ports that are different from an opening of the recess through which the working fluid flows to the inner side of the peripheral wall. Thus, when the oil droplets collide with the inner wall surface of the peripheral wall, the oil can be expelled smoothly through a nearest oil expelling port. This allows the oil slick formed on the inner wall surface of the peripheral wall to keep a small thickness, and makes it possible to reduce the pick-up of the oil from the surface of the oil slick occurring due to the flow of the working fluid.

Advantageous Effects of Invention

In the compressor according to the present invention, the working fluid to flow out through the discharge pipe inevitably passes through a space in which a speed component in the rotational direction is given to the working fluid by the rotation of the peripheral wall. Thereby, even fine oil droplets surely can be separated from the working fluid. Furthermore, the oil expelling ports allow the oil separated from the working fluid to be removed effectively from the vicinity of the inlet of the discharge pipe.

BRIEF DESCRIPTION OF DRAWINGS

FIG. 6 is a chart indicating an effect of reducing the amount of oil discharge achieved by the oil separation member of the compressor according to Embodiment 1 of the present invention.

DESCRIPTION OF EMBODIMENTS

Hereinafter, embodiments of the present invention are described with reference to the drawings.

Embodiment 1

Figure 1:
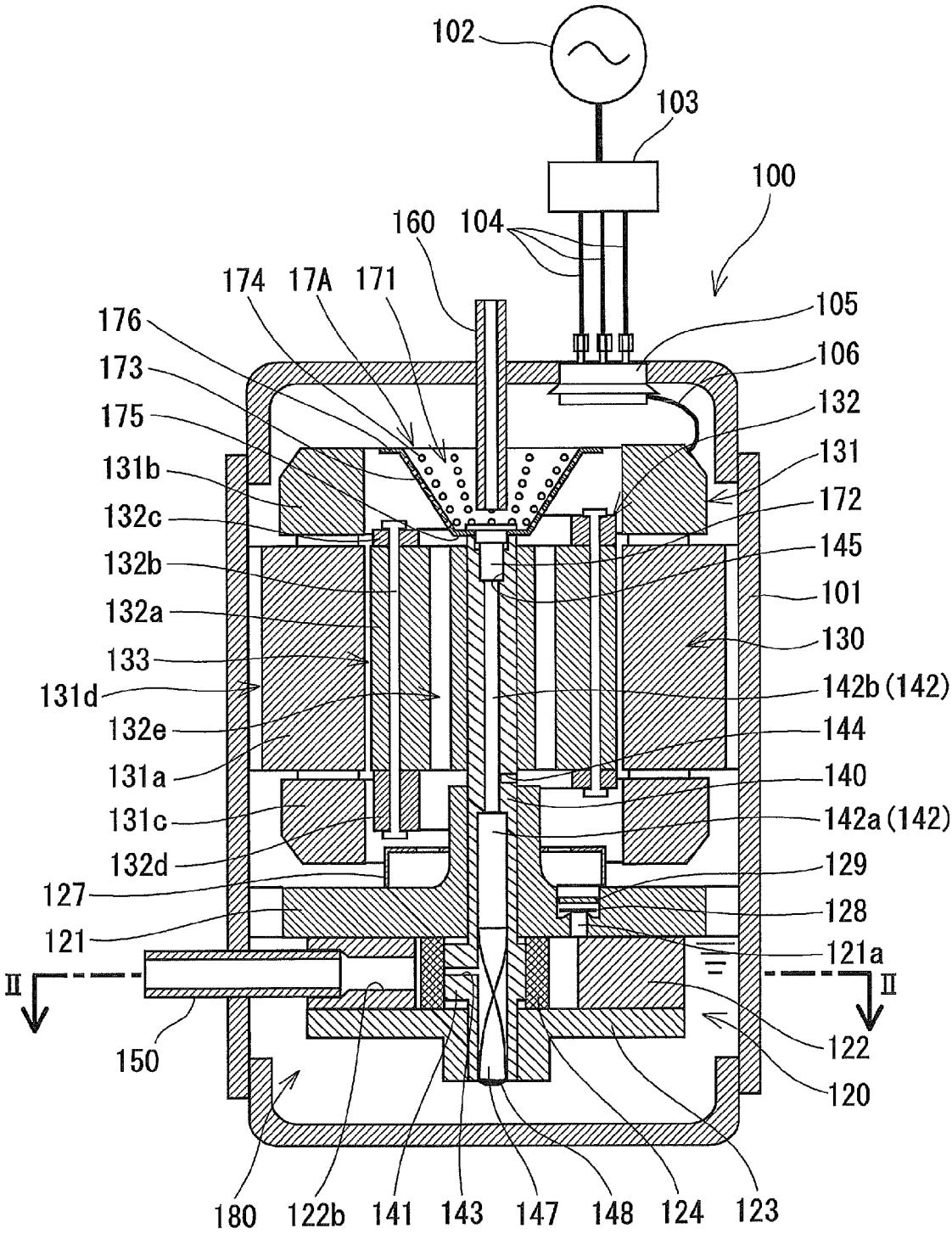
FIG. 1 is a vertical cross-sectional view of a compressor according to Embodiment 1 of the present invention.
Figure 2:
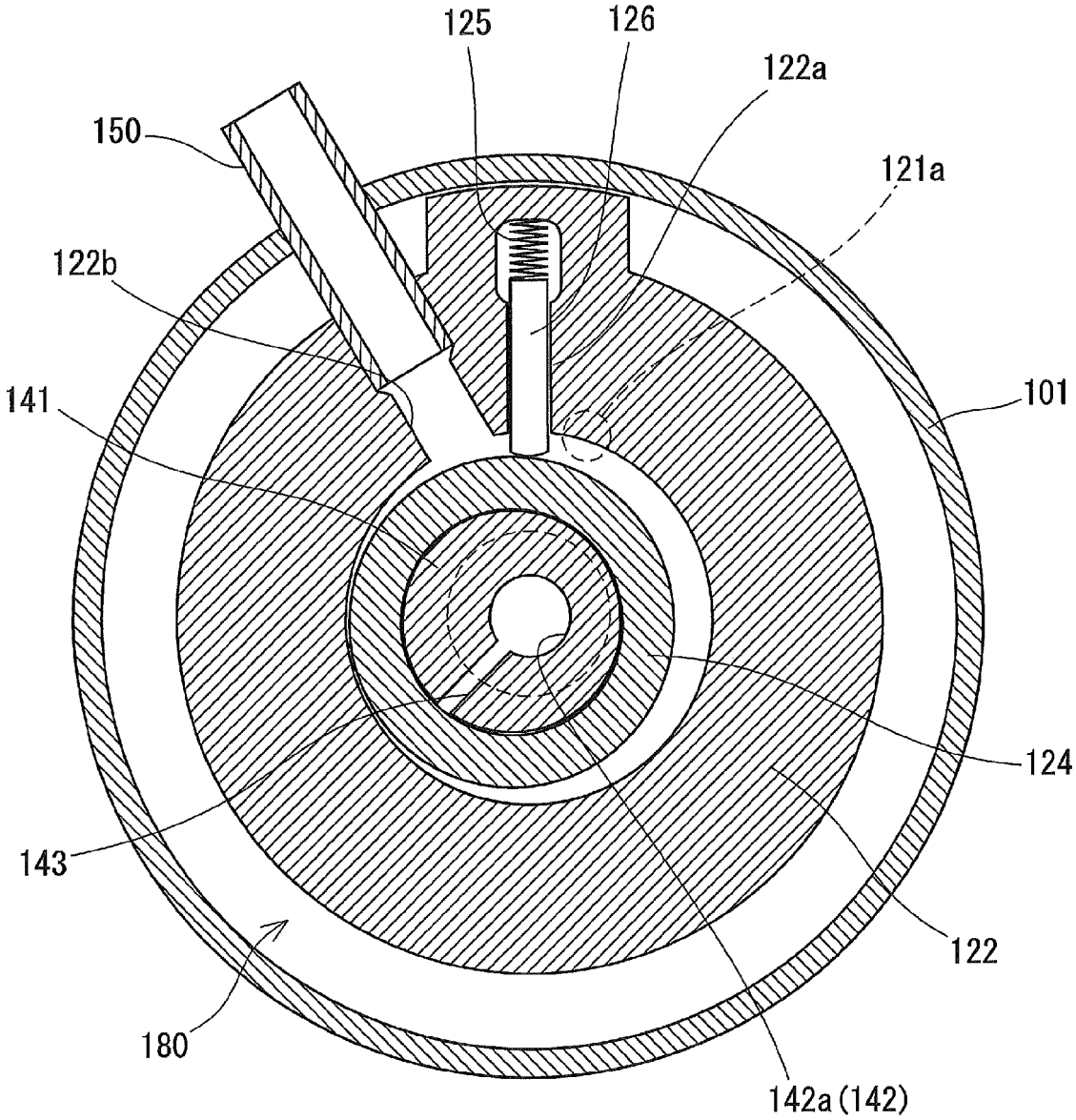
FIG. 2 is a cross-sectional view of FIG. 1 taken along the line II-II.
Figure 3:
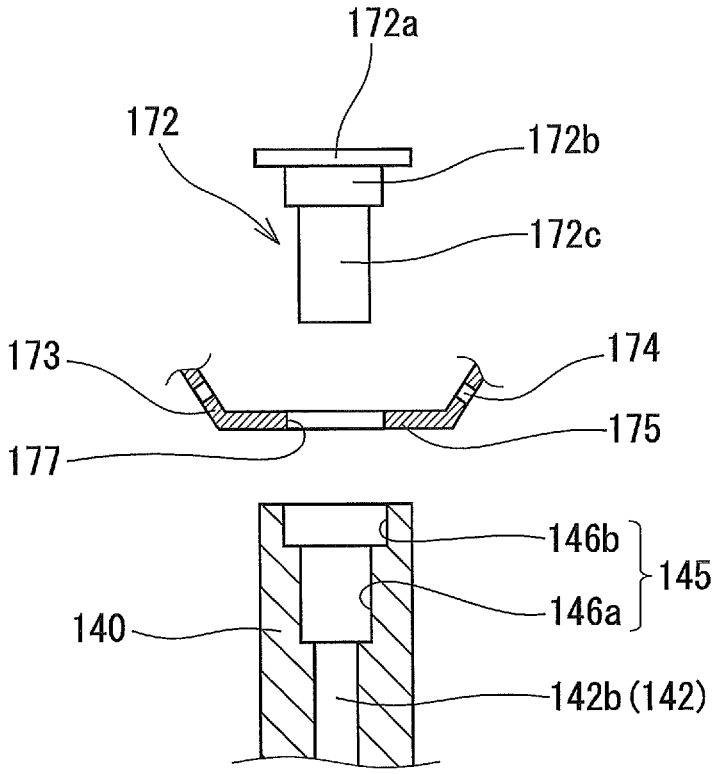
FIG. 3 is an exploded cross-sectional view illustrating a portion where an oil separating member is fixed to an end face of a shaft.

FIG. 1 is a vertical cross-sectional view of a compressor 100 according to Embodiment 1 of the present invention. FIG. 2 is a cross-sectional view of FIG. 1 taken along the line II-II. FIG. 3 is an enlarged exploded view of a part of FIG. 1. FIG. 6 is a chart indicating an effect of reducing the amount of oil discharge achieved by an oil separation member 17A employed in the compressor 100. Hereinafter, an example in which a refrigerant is used as the working fluid is described.

<<Configuration>>

In FIG. 1, the compressor 100 includes a closed casing 101, a compression mechanism 120 disposed at a lower position in the closed casing 101, and a motor 130 disposed above the compression mechanism 120 in the closed casing 101. The motor 130 is coupled to the compression mechanism 120 by a shaft 140 so that power can be transferred thereto. In the present embodiment, the axial direction of the shaft 140 is a vertical direction, but the axial direction of the shaft 140 may be a horizontal direction, for example. The oil separation member 17A is fixed to an upper end face of the shaft 140. That is, the oil separating member 17A is located, relative to the motor 130, opposite to the compression mechanism 120. The oil separation member 17A rotates together with the shaft 140.

A suction pipe 150 penetrating horizontally the closed casing 101 is fixed to a lower part of the closed casing 101. A discharge pipe 160 penetrating vertically the closed casing 101 is fixed to an upper part of the closed casing 101. The suction pipe 150 is connected directly to the compression mechanism 120. The discharge pipe 160 extends along an extension of a central axis of the shaft 140. The discharge pipe 160 has an inlet, which is a lower opening, that opens toward an internal space of the closed casing 101. Furthermore, at the lower part in the closed casing 101, an oil to be used to lubricate sliding parts is held around the compression mechanism 120 so as to form an oil puddle 180.

A terminal 105 connected, with power lines 104, to a driver 103 that is connected to an external power supply 102 is attached to the upper part of the closed casing 101 so as to penetrate the closed casing 101. The terminal 105 is connected to the motor 130 with a power line 106.

The compression mechanism 120 compresses the refrigerant and discharges it to the internal space of the closed casing 101. In the present embodiment, the compression mechanism 120 of rotary type is employed. Specifically, the compression mechanism 120 includes an upper bearing member 121 fixed to an inner circumferential surface of the closed casing 101 by welding or the like, a cylinder 122 disposed under the upper bearing member 121, and a lower bearing member 123 disposed under the cylinder 122. The upper bearing member 121 and the lower bearing member 123 support the shaft 140 rotatably.

As shown in FIG. 2, a piston 124 fitted rotatably around an eccentric portion 141 provided at a lower part of the shaft 140 is disposed inside the cylinder 122. The cylinder 122 is provided with a vane groove 122*a*. A vane 126 is inserted into the vane groove 122*a*. The vane 126 is in contact with an outer circumferential surface of the piston 124 at its tip, and is pressed against the piston 124 from the back by a vane spring 125. Referring back to FIG. 1, the cylinder 122 is provided with a suction passage 122*b* that links the suction pipe 150 to an inner space of the cylinder 122. The upper bearing member 121 is provided with a discharge passage 121*a* having one end that is in communication with the inner space of the cylinder 122 and the other end that is in communication with a space enclosed by a muffler 127 disposed above the upper bearing member 121. A discharge valve 128 and a valve stop 129 are disposed on the muffler 127 side of the discharge passage 121*a*.

The motor 130 drives the compression mechanism 120 via the shaft 140. Specifically, the motor 130 is composed of a stator 131 fixed to the inner circumferential surface of the closed casing 101 by welding or the like, and a rotor 132 fixed to the shaft 140 by shrinkage fit or the like. An air gap 133 is provided between the rotor 132 and the stator 131, and the rotor 132 is free from interference from the stator 131. An upper coil end 131*b* protruding above a stator core 131*a* and a lower coil end 131*c* protruding under the stator core 131*a* are formed in the stator 131 by winding the power line 106 around the stator core 131*a*. A plurality of cut-outs are provided in an outer circumferential portion of the stator core 131*a*. These cut-outs and an inner wall of the closed casing 101 define a plurality of outer refrigerant passages 131*d*. On the other hand, the rotor 132 includes a rotor core 132*a*, an upper balance weight 132*c* and a lower balance weight 132*d* both having a ring shape and respectively fixed to an upper end face and a lower end face of the rotor core 132*a*, and a plurality of caulking members 132*b* for caulk-fixing the upper balance weight 132*c* and the lower balance weight 132*d* to the rotor core 132*a*. In the rotor core 132*a*, a plurality of through holes penetrating through the rotor core 132*a* in the axial direction of the shaft 140 form a plurality of inner refrigerant passages (corresponding to rotor flow passages of the present invention) 132*e* inside the balance weights 132*c* and 132*d*. The inner refrigerant passages 132*e* are disposed on the same circumference at an equiangular interval, for example.

In the shaft 140, an oil supply channel 142 for supplying the oil in the oil puddle 180 to the compression mechanism 120 is formed on the central axis of the shaft 140 so as to penetrate through the shaft 140 in the vertical direction. That is, the oil supply channel 142 extends along the central axis of the shaft 140. A lower portion of the oil supply channel 142 is a large diameter portion 142*a* having a large diameter. An upper portion of the oil supply channel 142 is a small diameter portion 142*b* having a small diameter. An oil blade 147 for pumping up the oil is inserted into the large diameter portion 142*a* of the oil supply channel 142. An oil blade lid 148 is fixed under the oil blade 147 by being press-fitted into the large diameter portion 142*a*. An eccentric portion oil port 143 and a degassing port 144 are formed in the shaft 140. The eccentric portion oil port 143 opens from the large diameter portion 142*a* of the oil supply channel 142 to a sliding surface between the eccentric portion 141 and the piston 124. The degassing port 144 extends from an outer circumferential surface of the shaft 140 to the small diameter portion 142*b* of the oil supply channel 142 between the rotor 132 and the upper bearing member 121. Furthermore, an fastening hole 145 into which an after-mentioned fastening part 172 for fixing the oil separating member 17A to the upper end face of the shaft is inserted is provided at the upper end face of the shaft 140. The fastening hole 145 will be described later in detail.

The oil separating member 17A has a disc-shaped bottom wall 175 facing the upper end face of the shaft 140, and a peripheral wall 173 that extends from a periphery of the bottom wall 175 in a direction (upward direction) opposite to the shaft 140 and that is rotationally symmetric with respect to a perpendicular line passing a center of the bottom wall 175. A central axis of the peripheral wall 173 is located on the extension of the central axis of the shaft 140. The bottom wall 175 and the peripheral wall 173 form a recess 171 that opens, in a direction leading away from the shaft 140, with a size equal to or larger than a bottom face of the recess 171. That is, the bottom face of the recess 171 is defined by an upper face of the bottom wall 175. In the present embodiment, the peripheral wall 173 has a tapered shape extending upward from the periphery of the bottom wall 175 while expanding radially so that the recess 171 has an opening larger than the bottom face. However, the peripheral wall 173 may have a tube shape extending from the periphery of the bottom wall 175 in parallel with the axial direction of the shaft 140 so that the opening of the recess 171 has the same size as that of the bottom face, for example. Furthermore, in the present embodiment, the oil separating member 17A is provided with a flange portion 176 extending radially outward from an upper end of the peripheral wall 173 (an end portion of the peripheral wall 173 on a side opposite to the bottom wall 173).

The inlet of the discharge pipe 160 mentioned above is located on the central axis of the peripheral wall 173 and opens toward the bottom wall 175 in the recess 171. Preferably, a distance from the inlet of the discharge pipe 160 to the bottom wall 175 is ½ or less of a height of the peripheral wall 173 in the axial direction of the shaft 140. This is because when this distance is too long, the refrigerant from which the oil droplets have not yet been separated completely also flows into the inlet of the discharge pipe 160. More preferably, the distance from the inlet of the discharge pipe 160 to the bottom wall 175 is ¼ or less of the height of the peripheral wall 173. However, when the inlet of the discharge pipe 160 is close excessively to the bottom wall 175, the flow rate of the refrigerant therebetween becomes too high. Thus, the distance from the inlet of the discharge pipe 160 to the bottom wall 175 preferably is equal to or more than an inner diameter of the discharge pipe 160.

A plurality of oil expelling ports 174 through which the oil is expelled from an interior to an exterior of the peripheral wall 173 are provided in the peripheral wall 173 so as to be scattered in a circumferential direction of the peripheral wall 173 and the axial direction of the shaft 140. In the present embodiment, the oil expelling ports 174 are formed so that array circles in each of which a fixed number of the oil expelling ports 174 are arrayed at an equiangular pitch (a pitch of 30° in the example illustrated) are arranged in the axial direction of the shaft 140. In the example illustrated, the array circles are arranged in the axial direction of the shaft 140 at the same orientation as each other so that the oil expelling ports 174 are arranged radially when viewed from the axial direction of the shaft 140. However, the array circles may be arranged in the axial direction of the shaft 140 while they each change their orientations by half of the above-mentioned pitch so that the oil expelling ports 174 are arranged staggeredly when viewed from the axial direction of the shaft 140.

The oil expelling ports 174 can be formed by press-processing a metal plate at the same time when the oil separating member 17A is shaped. At this time, the oil expelling ports 174 preferably are formed by punching the peripheral wall 173 in a direction from an inner side to an outer side of the peripheral wall 173.

Preferably, the peripheral wall 173 expands radially so that the refrigerant discharged from the compression mechanism 120 reaches the peripheral wall 173 through the inner refrigerant passages 132*e* provided in the rotor of the motor 130 and is guided outward by the peripheral wall 173. That is, it is preferable that a lower end of the peripheral wall 173 (an end portion of the peripheral wall 173 on the bottom wall 175 side) is located at a position more radially inward than those of the inner refrigerant passages 132*e*, and the upper end of the peripheral wall 173 is located at a position radially outward than those of the inner refrigerant passages 132*e*. This is because with such a configuration, the oil discharged to the exterior of the peripheral wall 173 through the oil expelling ports 174 can be guided to an outer circumferential side of the stator 131 by the refrigerant flowing up through the inner refrigerant passages 132*e*, and the return of the oil to the oil puddle 180 is performed smoothly.

As shown in FIG. 3, a through hole 177 having a circular shape centered on the central axis of the peripheral wall is formed at the center of the bottom wall 175.

The fastening part 172 is an rod member having an approximately T-shaped cross section. The fastening part 172 is composed of a head portion 172*a* having a larger diameter than that of the through hole 177, a positioning portion 172*b* that is fitted into the through hole 177 and has a slightly smaller diameter than that of the through hole 177, and a press-in portion 172*c* having a smaller diameter than that of the positioning portion 172*b*. All of the portions 172*a* to 172*c* are concentric with each other.

On the other hand, the fastening hole 145 into which the fastening part 172 is inserted has a shape recessed in two steps from the upper end face of the shaft 140. The fastening hole 145 is composed of an entry-side clearance hole 146*b* into which the positioning portion 172*b* is fitted loosely, and a deeper-side holding hole 146*a* into which the press-in portion 172*c* is press-fitted. The holding hole 146*a* is concentric with the central axis of the shaft 140, and has a diameter that is larger than that of the small diameter portion 142*b* of the oil supply channel 142 and slightly smaller than that of the press-in portion 172*c*. The clearance hole 146*b* is concentric with the central axis of the shaft 140, and has a diameter that is larger than those of the holding hole 146*a* and the positioning portion 172*b*. The clearance hole 146*b* has a depth that is larger than a value obtained by subtracting the thickness of the bottom wall 175 from the height of the positioning portion 17*b*.

The oil separating member 17A is fixed to the upper end face of the shaft 140 by allowing the fastening part 172 to pass through the through hole 177 so that the press-in portion 172*c* is located on the holding hole 146*a* side, press-fitting the press-in portion 172*c* into the holding hole 146*a*, and sandwiching the bottom wall 175 between the upper end face of the shaft 140 and the head portion 172*a* of the fastening part 172. At this time, the positioning portion 172*b* is fitted into the through hole 177 so as to determine the position of the oil separating member 17A with respect to the shaft 140. Furthermore, the clearance hole 146*b* prevents the positioning portion 172*b* from interfering with the shaft 140.

Next, the number and size of the oil expelling ports 174 are described with reference to FIG. 4 and FIG. 5.

Figure 4:
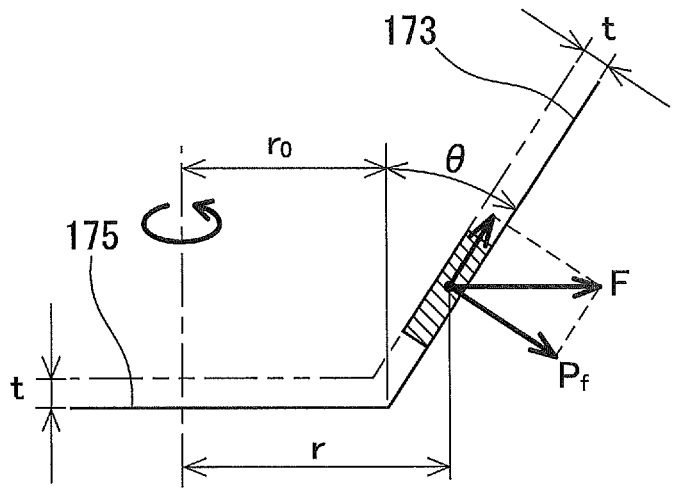
FIG. 4 is a diagram for explaining a plane pressure occurring due to a centrifugal force.

First, assume that an oil slick having a uniform thickness t [m] is formed on the bottom wall 175 and the peripheral wall 173 as shown in FIG. 4. A plane pressure $P_f$ [Pa] acting, at a position located a distance r [m] away from a rotation axis, on the peripheral wall 173 due to a centrifugal force is a value obtained by multiplying a centrifugal force F [N] acting on an unit area (1 $m^2$) of the oil slick on the peripheral wall 173 by cos θ (θ is an angle [rad] with respect to the rotation axis of the peripheral wall). Thus, the plane pressure $P_f$ is represented by the following equation 1.

[Equation 1]

$$P_f = \rho \times t \times r \times \omega^2 \times \cos\theta \quad \text{(Equation 1)}$$

ρ: Density [kg/$m^3$] of the oil

ω: Rotational speed [rad/s]

On the other hand, a speed V [m/s] of the oil passing through the oil expelling ports 174 is represented by the following equation 2, when the volumetric flow rate of the oil is defined as M [$m^3$/s], the diameter of the oil expelling ports 174 is defined as D [m] and the number of the oil expelling ports 174 is defined as N (ports), and all of the oil is assumed to be expelled uniformly through the oil expelling ports 174.

[Equation 2]

$$V = \frac{M}{\left(\frac{D}{2}\right)^2 \times \pi \times N} \quad \text{(Equation 2)}$$

A pressure loss $P_{loss}$ [Pa] at the oil expelling ports 174 is represented by the following equation 3 according to the Darcy-Weisbach equation.

[Equation 3]

$$P_{loss} = \lambda \times \frac{T}{D} \times \frac{\rho \times V^2}{2} \quad \text{(Equation 3)}$$

T: Thickness [m] of the peripheral wall

The pipe friction coefficient λ in the equation 3 is calculated from the following equation 4. The Reynolds number Re in the equation 4 is calculated from the following equation 5.

[Equation 4]

$$\lambda = \frac{64}{Re} \quad \text{(Equation 4)}$$

[Equation 5]

$$Re = \frac{V \times D}{\nu} \quad \text{(Equation 5)}$$

ν: Kinetic viscosity of the oil [$m^2$/s]

The equation 3 can be rewritten as the following equation 6, according to the equation 4 and the equation 5.

[Equation 6]

$$P_{loss} = \frac{128 \times v \times T \times \rho \times M}{D^4 \times \pi \times N} \quad \text{(Equation 6)}$$

A necessary condition for the oil to be expelled through the oil expelling ports 174 by a centrifugal force is as represented by the following equation 7.

[Equation 7]

$$P_f \geq P_{loss} \quad \text{(Equation 7)}$$

The centrifugal force decreases as the distance from the rotation axis decreases. Accordingly, the position where the condition is most severe is the lower end of the peripheral wall 173. Thus, the equation 7 is rewritten as the following equation 8 by substituting the equation 1 and the equation 6 into the equation 7, using a minimum radius $r_0$ [m] of the peripheral wall 173 as r in the equation 1, and further moving variables to the left side and numerical values to the right side of the equation.

[Equation 8]

$$\frac{r_0 \times \omega^2 \times \cos\theta \times t \times D^4 \times N}{v \times T \times M} \geq \frac{128}{\pi} \quad \text{(Equation 8)}$$

Figure 5:
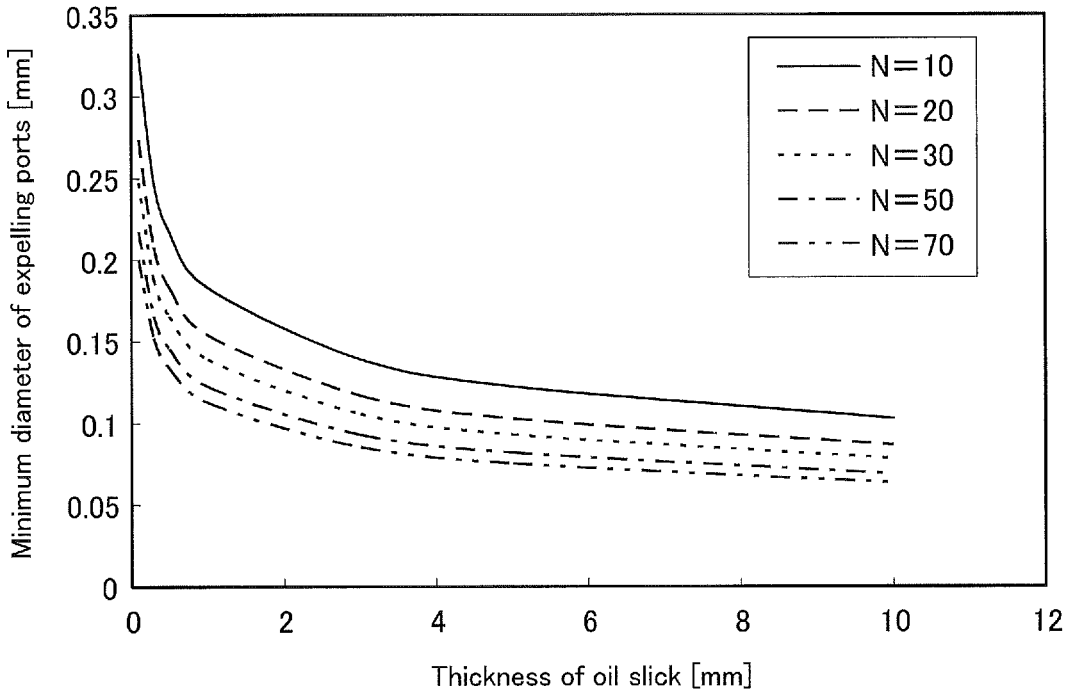
FIG. 5 is a graph showing a relationship between a thickness of an oil slick and a minimum diameter of expelling ports.

Here, when the following conditions are substituted into the equation 8, the relationship between the thickness t of the oil slick and a minimum diameter (a lower limit value of D determined from the equation 8) of the expelling ports changes in accordance with the number N of the expelling ports as shown in FIG. 5.

Conditions for the oil: $v=5\times10^{-6}$ [$m^2$/s], $M=4.7\times10^{-7}$ [$m^3$/s]

Shape of the peripheral wall: $r_0=0.025$ [m], $\theta=0.52$ [rad] (=30 [deg]), T=0.001 [m]

Rotational speed: $\omega=628$ [rad/s] (=100 [rps])

As described above, it is preferable that the inlet of the discharge pipe 160 is present as closer to the bottom wall 175 as possible. To achieve this, it is necessary to suppress the thickness t of the oil slick on the bottom wall 175. For example, in order to suppress the thickness t of the oil slick on the bottom wall 175 to 0.1 mm or less, the diameter D of the oil expelling ports 174 needs to be 0.2 mm or more according to FIG. 5 when N=70 [ports].

<<Operation>>

Next, the operation of the compressor 100 is described. The driver 103 adjusts electric power supplied from the external power supply 102 to a frequency and a voltage for driving the motor, and this electric power is supplied to the power line 106 through the power lines 104 and the terminal 105. Thereby, a magnetic field is generated in the stator core 131*a* of the stator 131. A change in the magnetic field in the stator core 131*a* generates a rotation torque between the rotor 132 and the stator 131. This rotation torque rotates the rotor 132, and the shaft 140 to which the rotor 132 is fixed also starts its rotational motion. Eccentric motion of the eccentric portion 141 caused by the rotation of the shaft 140 changes the volumetric capacities of two compression chambers between the piston 124 fitted rotatably around the eccentric portion 141 and the cylinder 122 (compression chambers closed by the upper bearing member 121 and the lower bearing member 123 from top and bottom) that are separated from each other by the vane 126. During the time when being in communication with the suction passage 122*b*, the compression chamber is in a suction process, and an increase in the volumetric capacity of the compression chamber caused by the rotation of the shaft 140 allows the compression chamber to draw the refrigerant through the suction pipe 150 and the suction passage 122*b*. As the shaft 140 rotates further, the piston 124 blocks the communication between the compression chambers and the suction passage 122*b* and the compression chamber shifts to compression and discharge processes. In the compression and discharge processes, a decrease in the volumetric capacity of the compression chamber caused by the rotation of the shaft 140 compresses the refrigerant, and the discharge valve 128 is opened when the pressure in the compression chamber reaches a discharge pressure on the muffler 127 side, so that the refrigerant is pushed out from the compression chamber into the space enclosed by the muffler 127 through the discharge passage 121*a*. The refrigerant muffled by the muffler 127 is discharged to a region under the motor 130.

The oil is mixed with the refrigerant to be discharged to the region under the motor 130 when the refrigerant passes through the compression chambers. This is because since the internal space of the closed casing 101 is filled with the pressure (discharge pressure) of the discharge refrigerant from the compression mechanism 120, the oil having the discharge pressure is present in a back space of the vane 126 that opens to the oil puddle 180, and inside the piston 124 that is exposed to the oil puddle 180 through the oil supply channel 142 and the eccentric portion oil port 143. That is, the cause of the above is that the oil having the discharge pressure leaks from a clearance around the vane 126 and clearances above and below the piston 124 toward the compression chamber in the suction process having a suction pressure lower than the discharge pressure and the compression chamber in the compression process having a pressure between the discharge pressure and the suction pressure. Thus, the refrigerant discharged to the region under the motor 130 contains micron-size oil droplets.

The refrigerant that has been discharged to the region under the motor 130 is blown upward to a region above the motor 130 by passing through the inner refrigerant passages 132*e* of the rotor 132, the air gap 133 or the outer refrigerant passages 131*d* of the stator 131. The refrigerant that has reached the region above the motor 130 flows, toward the inlet of the discharge pipe 160, from the opening of the recess 171 to the inside the oil separating member 17A, and is discharged to a refrigeration cycle outside of the compressor through the discharge pipe 160 after the oil is separated therefrom in the recess 171.

The oil separated from the refrigerant in the recess 171 is expelled to the outside of the oil separating member 17A through the oil expelling ports 174. The oil expelled through the oil expelling ports 174 is further expelled radially outward, from between the flange portion 176 and the upper coil end 131*b*, above the upper coil end 131*b* together with the refrigerant being blown upward through the air gap 133 or the inner refrigerant passages 132*e*. And the oil returns to the oil puddle 180 through the periphery around the upper coil end 131*b*, the outer refrigerant passages 132*e*, and openings provided at proper places of the upper bearing member 121.

<<Effects>>

When the oil separating member 17A fixed to the shaft 140 rotates in the region above the motor 130, a speed component in the rotational direction is given to the refrigerant in the region above the motor 130. Thereby, the oil droplets floating in the refrigerant and having a larger specific gravity than that of the refrigerant are separated centrifugally to the side of the inner circumferential surface of the closed casing 101. Particularly, the refrigerant in the vicinity of the discharge pipe 160 in the recess 171 has a large speed component in the rotational direction because it is surrounded by the peripheral wall 173, and thus even fine oil droplets floating in the refrigerant can be separated centrifugally. Furthermore, since the peripheral wall 173 is provided with the oil expelling ports 174, the oil that has been separated centrifugally and landed on the inner wall surface of the peripheral wall 173 can be expelled to the outer side of the peripheral wall 173 through the oil expelling ports 174. This allows the separated oil to be expelled, by utilizing a centrifugal force, to the outer side of the peripheral wall 173 through the oil expelling ports 174 that are different from the opening of the recess 171 through which the refrigerant flows to the inner side of the peripheral wall 173, without countering the flow of the refrigerant. Thus, when the oil droplets collide with the inner wall surface of the peripheral wall 173, the oil can be expelled smoothly through a nearest oil expelling port 174. Thereby, the oil slick on the inner wall surface of the peripheral wall can keep a small thickness, and it is possible to reduce the re-pick-up of the oil from the surface of the oil slick occurring due to the flow of the working fluid.

From the viewpoint of the balance of the acting force when the oil passes through the oil expelling ports 174, in the case where the amount of the oil droplets floating in the refrigerant increases, the amount of the oil to be expelled to the outer side of the peripheral wall 173 through the oil expelling ports 174 also increases, and thus the pressure loss when the oil passes through the oil expelling ports 174 increases. On the other hand, however, the thickness of the oil that has landed on the inner wall surface of the peripheral wall 173 increases, and thereby the pressure of the oil in a direction perpendicular to the inner wall surface of the peripheral wall 173 due to the centrifugal force is increased, offsetting the pressure loss autonomously.

Furthermore, since the peripheral wall 173 is tapered and has an inner diameter decreasing toward the bottom wall 175, the oil that has landed on the inner wall surface of the peripheral wall 173 flows, due to the influence of the centrifugal force acting on the oil, on the inner wall surface of the peripheral wall 173 toward the upper end of the peripheral wall 173 so as to move away from the vicinity of the discharge pipe 160. And before reaching the upper end of the peripheral wall 173, the oil is expelled through the oil expelling ports 174 located on the way thereto. Moreover, since the bottom wall 175 is present on the motor 130 side of the peripheral wall 173, it is possible to prevent the refrigerant containing oil droplets and passing through the inner refrigerant passages 132*e* of the rotor 132 from shortcutting to the discharge pipe 160 from the side opposite to the opening of the recess 171. Furthermore, since the inlet of the discharge pipe 160 is disposed on the central axis of the peripheral wall 173 and on the inner side of the peripheral wall 173, the refrigerant that contains a most reduced amount of oil droplets because of the centrifugal separation by the peripheral wall 173 can be discharged to the refrigeration cycle outside of the compressor.

Moreover, since the fastening part 172 is press-fitted into an upper part of the shaft 140 so as to sandwich the oil separating member 17A, the oil separating member 17A can be fixed to the shaft 140 even when the oil separating member 17A has a simple shape that can be shaped easily by press processing. Thus, the oil separating member 17A can be produced at low cost. Furthermore, since the oil separating member 17A can be fixed by the easy assembling in which the fastening part 172 is press-fitted into the shaft 140, only a short additional processing time is necessary for mounting the oil separating member 17A, compared to the case of assembling a conventional compressor having no oil separation member. Therefore, an increase in the production cost can be suppressed. In addition, since the holding hole 146*a* of the fastening hole 145 is concentric with the shaft 140 and the positioning portion 172*b* and the press-in portion 172*c* of the fastening part 172 are concentric with each other, and furthermore the through hole 177 is provided at the center of the bottom wall 175 of the oil separating member 17A, it is possible to align easily an axial center of the oil separating member 17A (the center of the bottom wall 175 and the central axis of the peripheral wall 173) with the central axis of the shaft 140 only by allowing the positioning portion 172*b* of the fastening part 172 to pass through the through hole 177 and press-fitting the press-in portion 172*c* into the holding hole 146*a*. As a result, it is possible to prevent the oil separating member 17A from being a new imbalance factor related to the shaft 140. However, the axial center of the oil separating member 17A may be deviated slightly from the central axis of the shaft 140. In this case, the peripheral wall 173 makes a small eccentric motion and the speed component in the rotational direction is transferred easily to the refrigerant around the peripheral wall 173, thereby accelerating the centrifugal separation of the oil. Moreover, the clearance hole 146*b* provided in the shaft 140 prevents interference between the positioning portion 172*b* and the fastening hole 145 at the time of inserting the fastening part 172 into the fastening hole 145 of the shaft 140. Accordingly, accuracy control for the length of the positioning portion 172*b* is unnecessary. Thereby, the fastening part 172 can be produced at low cost.

Since the degassing port 144 that penetrates the shaft 140 from the oil supply channel 142 to the outer circumferential side of the shaft 140 between the rotor 132 and the upper bearing members 121 is provided, the discharge pressure can act on a boundary surface of the oil supplied from a lower part of the oil supply channel 142 even when an upper end of the oil supply channel 142 is closed by the fastening part 172. Moreover, even when the refrigerant dissolved in the oil makes bubbles in the oil supply channel 142 at the time of start-up, etc., it is possible to retain the oil up to a required height in the oil supply channel 142 by expelling the bubbling refrigerant through the degassing port 144.

The oil expelled through the oil expelling ports 174 is mixed with the oil droplets-containing refrigerant blown out from the inner refrigerant passages 132*e* of the rotor 132. This causes the refrigerant to contain a larger amount of oil droplets. In the case where this refrigerant is guided from the upper end of the peripheral wall 173 to the inner side of the peripheral wall 173 along the flow of the refrigerant, the amount of oil to be expelled from the inner side of the peripheral wall 173 increases. In contrast, in the case where the flange portion 176 is provided as in the present embodiment, it is possible to prevent the flow of the refrigerant on the outer side of the peripheral wall 173 from turning at the upper end of the peripheral wall 173 and shortcutting to the inner side of the peripheral wall 173. Thus, the refrigerant supplied to the inner side of the peripheral wall 173 is in the state where oil droplets are roughly separated therefrom by the flow of the refrigerant in the rotational direction in the region above the motor 130 caused by the rotations of the rotor 132, the upper balance weight 132*c* and the oil separating member 17A. Thereby, the burden of separating the oil on the inner side of the peripheral wall 173 can be reduced.

Furthermore, in the case where the oil expelling ports 174 are formed by punching the peripheral wall 173 in the direction from the inner side to the outer side of the peripheral wall 173, the oil expelling ports 174 each have an inner shape in which an opening decreases gradually in size from the inner side toward the outer side of the peripheral wall 173, and on the other hand have an outer shape with burrs. Thus, it is easy for the oil to be expelled from the inner side to the outer side of the peripheral wall 173 through the oil expelling ports 174 from the viewpoint of the pressure loss of the fluid, but in contrast, it is not easy for the refrigerant to leak from the outer side to the inner side of the peripheral wall 173. That is, it is possible to expel the oil easily from the inner side of the peripheral wall 173 while preventing the refrigerant from shortcutting from the outer side to the inner side of the peripheral wall 173 through the oil expelling ports 174. Thereby, the amount of oil discharged through the discharge pipe 160 can be reduced.

Furthermore, since the oil expelling ports 174 are formed evenly in the peripheral wall 173, the oil landing on the inner wall surface of the peripheral wall 173 can be expelled promptly to the outer side of the peripheral wall 173 through a nearest oil expelling port 174 no matter at any location on the inner side of the peripheral wall 173 the oil droplets are separated from the refrigerant. Therefore, it is possible to prevent the oil that has landed on the inner wall surface of the peripheral wall 173 from being picked up again due to the flow of the refrigerant.

It has been confirmed on an actual apparatus that the amount of oil discharged through the discharge pipe 160 can be reduced to 1/9 or less by the above-mentioned effects of the oil separating member 17A described in Embodiment 1 of the present invention as shown in FIG. 3. In the actual apparatus, the number of the oil expelling ports 174 is 70 and the diameter of the oil expelling ports 174 is 0.5 mm. This diameter is a value taking a safety factor of 2.5 on a diameter (0.2 mm) that is determined from FIG. 5 and necessary to suppress the thickness t of the oil slick on the bottom wall 175 to 0.1 mm or less.

Embodiment 2

Figure 7:
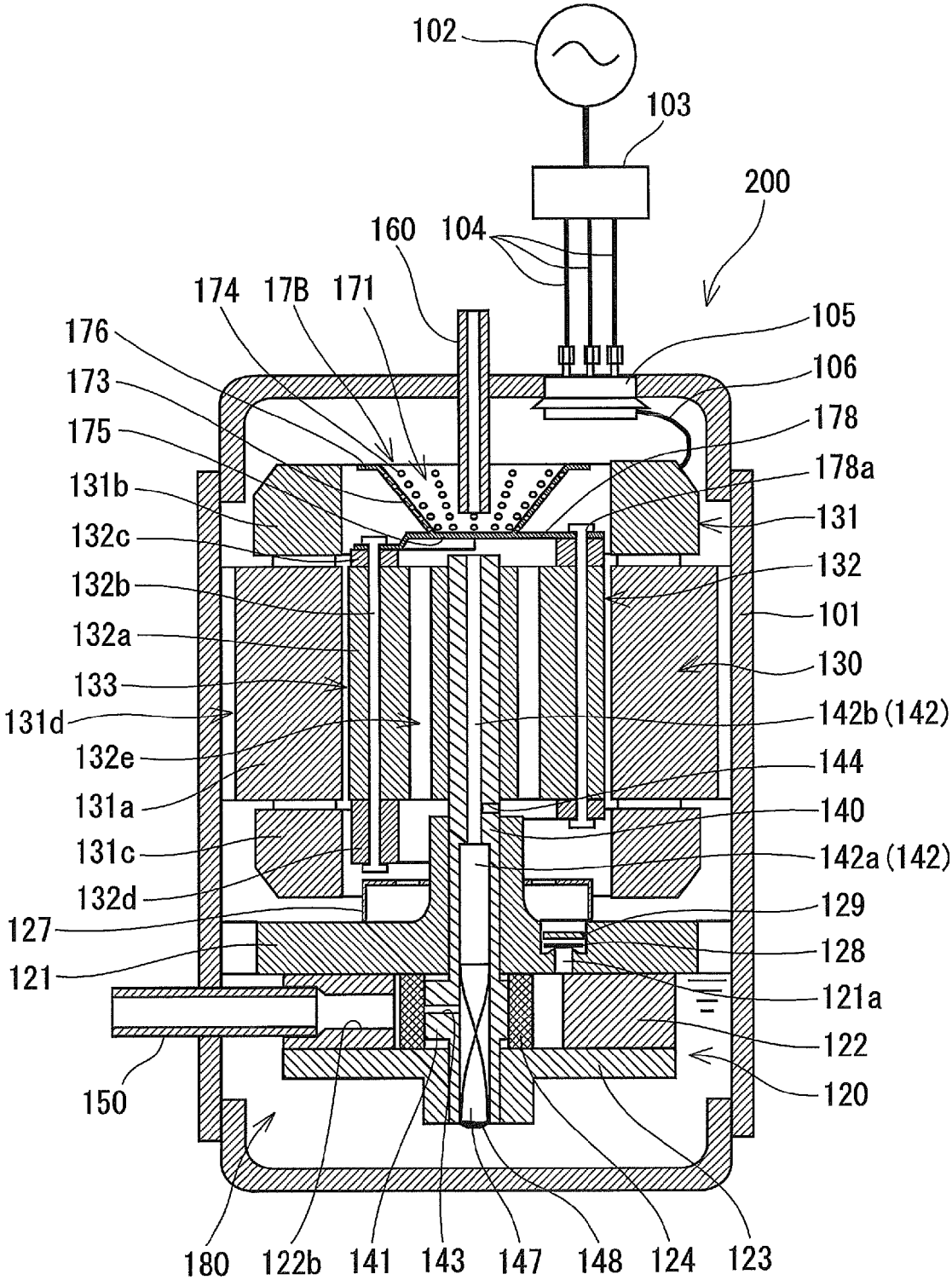
FIG. 7 is a vertical cross-sectional view of a compressor according to Embodiment 2 of the present invention.

FIG. 7 is a vertical cross-sectional view of a compressor 200 according to Embodiment 2 of the present invention. In FIG. 7, the same components as those in FIG. 1 and FIG. 2 are indicated with the same reference numerals and the descriptions thereof are omitted.

<<Configuration>>

In the present embodiment, an oil separating member 17B fixed to the rotor 131 of the motor 130 is employed. Specifically, in the oil separating member 17B, the through hole 177 (see FIG. 3) is not provided in the bottom wall 175, and instead an annular supporting portion 178 surrounding the bottom wall 175 is provided to the bottom wall 175 continuously. The oil separating member 17B may be obtained by forming the bottom wall 175 and the supporting portion 178 with a single metal plate and fixing the lower end of the peripheral wall 173 to this metal plate by welding or the like.

A plurality of through holes 178*a* through which the respective caulking members 132*b* of the rotor 132 of the motor 130 extend is formed in the supporting portion 178. The lower balance weight 132*d*, the rotor core 132*a*, the upper balance weight 132*c* and the supporting portion 278 are stacked in order and caulk-fixed by the caulking members.

In the example illustrated, the supporting portion 178 has a three-dimensional shape matching the shape of the upper balance weight 132*c*. However, the supporting portion 178 may be flat, and a spacer matching the shape of the upper balance weight 132*c* may be disposed between the supporting portion 178 and the upper balance weight 132*c*.

<<Effects>>

Other than the fact that the length of the caulking members 132*b* is elongated only by the thickness of the supporting portion 178 because the supporting portion 178 of the oil separating member 17B is caulk-fixed, together with other components of the rotor 132, to the rotor core 132*a* by the caulking members 132*b*, it is not necessary to change the shapes of the other components of the compressor 200. Accordingly, the oil separating member 17B can be retrofitted easily to a conventional compressor and can be mounted in the process of producing the motor 130, and thus there is almost no change to the assembling process of the compressor 200. Therefore, high oil separation capability can be added at low cost.

Other Embodiments

Figure 8:
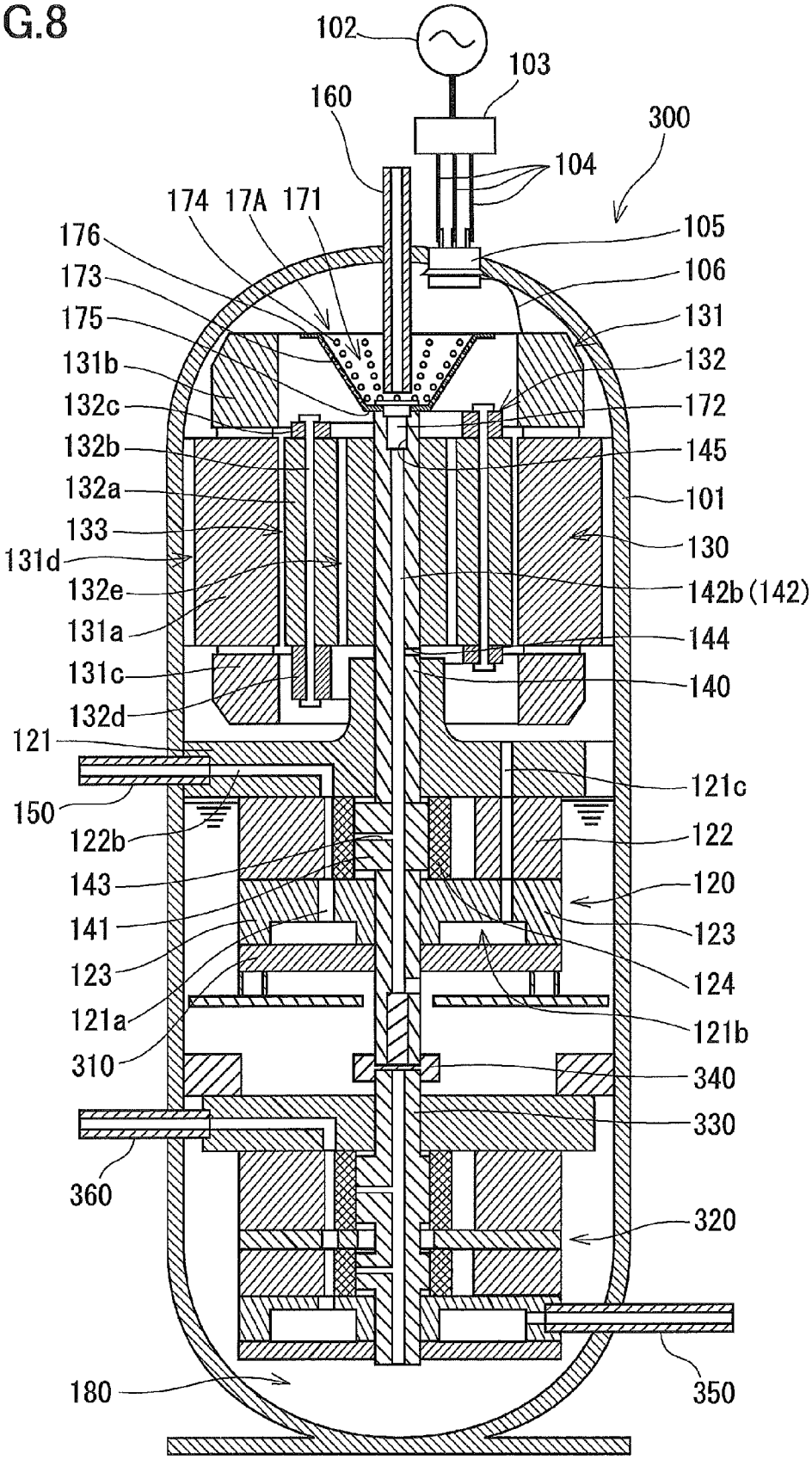
FIG. 8 is a vertical cross-sectional view of a compressor according to another embodiment.
Figure 9:
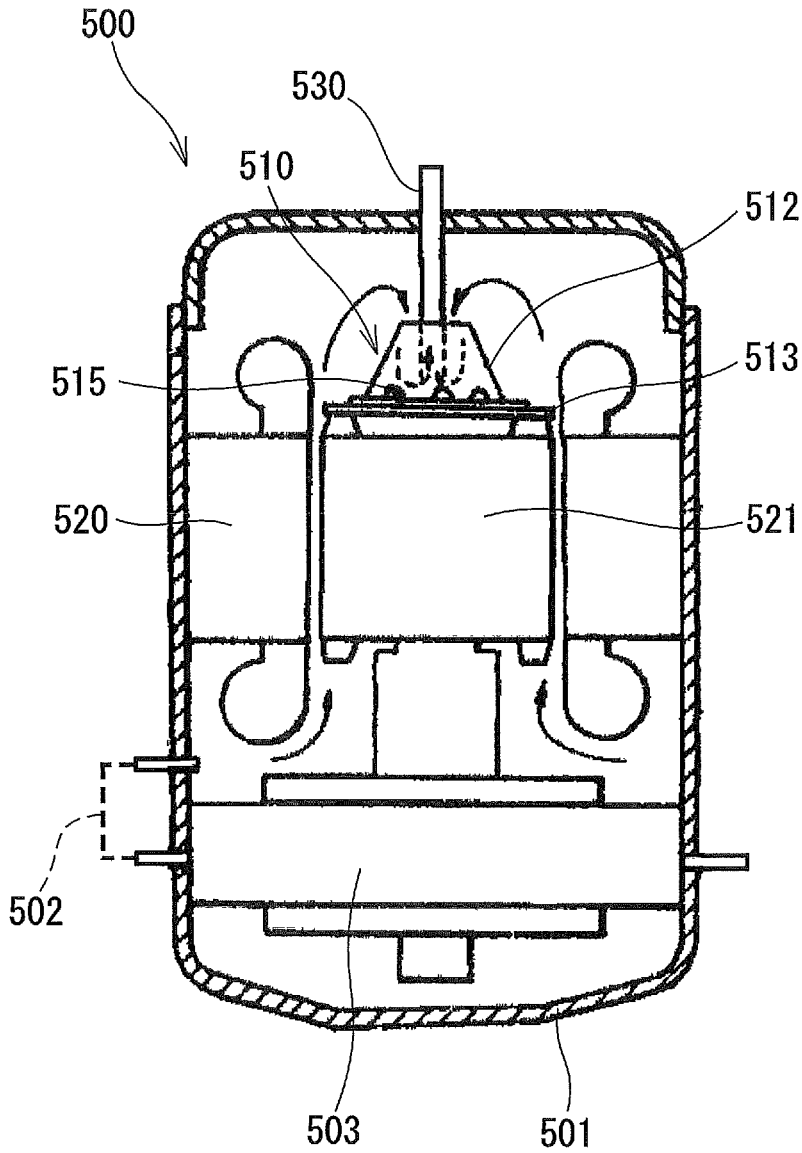
FIG. 9 is a vertical cross-sectional view of a conventional compressor.
Figure 10:
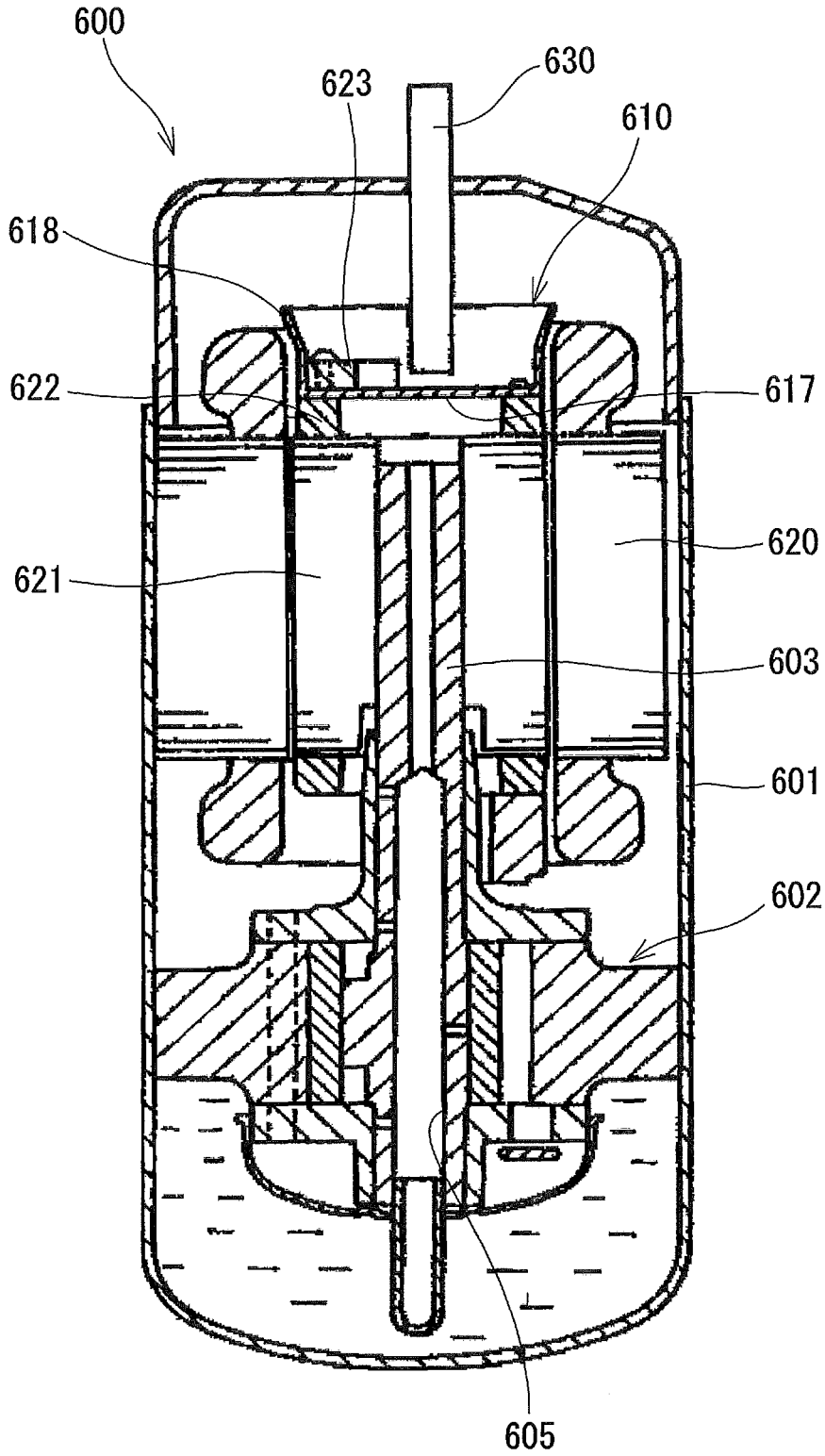
FIG. 10 is a vertical cross-sectional view of another conventional compressor.

The compressor of the present invention is not limited to a compressor in which only the compression mechanism 120 is disposed as a fluid machine in the closed casing 101, as described in Embodiment 1 and Embodiment 2. For example, as shown in FIG. 8, an expansion mechanism 320 that recovers power from an expanding refrigerant and transfers the recovered power to the shaft 140 may be disposed in the closed casing 101. The expansion mechanism 320 has a subshaft 330 coupled to the shaft 140 by a coupler 340. The expansion mechanism 320 draws the refrigerant from the outside of the compressor through a suction pipe 350 penetrating the closed casing 101, and discharges the expanded refrigerant to the outside of the compressor though a discharge pipe 360 penetrating the closed casing 101.

In the compression mechanism 120 shown in FIG. 8, the suction passage 122*b* is provided in the upper bearing member 121 and the discharge passage 121*a* is provided in the lower bearing member 123. A closing member 310 that closes a discharge chamber 121*b* provided in the lower bearing member 123 is disposed under the lower bearing member 123. A second discharge passage 121*c* through which the discharge chamber 121*b* and the region under the motor 130 are in communication with each other is provided so as to penetrate through the lower bearing member 123, the cylinder 122 and the upper bearing member 121.

The closed casing 101 shown in FIG. 8 may be divided into two to accommodate the compression mechanism 120 and the expansion mechanism 320 separately, and these closed casings may be connected to each other by an oil equalizing pipe and a pressure equalizing pipe. Furthermore, in the closed casing accommodating the expansion mechanism 320, a power generator may be attached to the subshaft 330, and the oil separating member 17A (or 17B) may be fixed to a rotor of the power generator or to the subshaft 330.

The compressor of the present invention exhibits the effect of separating effectively the oil from the working fluid by using the centrifugal separation action achieved by allowing the peripheral wall to give the working fluid the speed component in the rotational direction and the action of preventing the oil droplets from being picked up again because of the working fluid by expelling the separated oil to the outer side of the peripheral wall through the oil expelling ports provided in the peripheral wall. Although the motor 130 and the compression mechanism 120 are arranged along the vertical direction in Embodiment 1 and Embodiment 2, the above-mentioned effects are not affected even in the case where they are arranged along a horizontal direction. That is, the present invention is not limited to vertical compressors. Moreover, the above-mentioned effects are not affected by the type of the compression mechanism, either. Therefore, the compression mechanism is not limited to rotary type, and various types of compression mechanisms, such as scroll, swing, reciprocating, vane rotary, helical, screw and turbo types, can be used.

Furthermore, the oil separating member of the present invention does not necessarily have to be located, relative to the motor, opposite to the compression mechanism. For example, in the configuration shown in FIG. 1, the motor 130 and the compression mechanism 120 may be disposed in a vertically reverse manner, and the oil separating member 17A may be fixed to an end face of the shaft 140 on the compression mechanism 120 side. In this case, the degassing port 144 may be formed between the compression mechanism 120 and the oil separating member 17A.

INDUSTRIAL APPLICABILITY

The compressor of the present invention includes a high performance and inexpensive oil separating member, and is useful as a compressor used for refrigeration cycles in air conditioners, heat pump water heaters, heat pump heaters, freezers, automotive air-conditioners, etc.

The invention claimed is:

1. A compressor comprising:

a closed casing;

a compression mechanism disposed in the closed casing so as to compress a working fluid and discharge the working fluid to an internal space of the closed casing;

a motor disposed in the closed casing so as to drive the compression mechanism via a shaft;

an oil separating member having a peripheral wall and a bottom wall that form a recess that opens, in a direction leading away from the shaft, with a size equal to or larger than a bottom face of the recess, the oil separating member being configured to rotate together with the shaft; and a discharge pipe penetrating the closed casing and having an inlet that opens toward the bottom wall in the recess, wherein the peripheral wall has a tapered shape extending in the axial direction of the shaft from a periphery of the bottom wall while expanding radially, a plurality of oil expelling ports are provided in the peripheral wall of the oil separating member so as to be distributed in a circumferential direction of the peripheral wall and an axial direction of the shaft, and the oil expelling ports each have an inner shape in which an opening decreases gradually in size from an inner side of the peripheral wall toward an outer side of the peripheral wall.

2. The compressor according to claim 1, wherein a distance from the inlet of the discharge pipe to the bottom wall is ½ or less of a height of the peripheral wall in the axial direction of the shaft.

3. The compressor according to claim 1, further comprising a fastening part for fixing the oil separating member to an end face of the shaft.

4. The compressor according to claim 3, wherein a through hole is provided at a center of the bottom wall, the fastening part has a head portion having a larger diameter than that of the through hole, a positioning portion fitted into the through hole, and a press-in portion having a smaller diameter than that of the positioning portion, and a fastening hole into which the fastening part is inserted is provided at the end face of the shaft, and the fastening hole includes a holding hole into which the press-in portion is press-fitted and a clearance hole into which the positioning portion is fitted loosely.

5. The compressor according to claim 4, wherein an oil supply channel that is for supplying oil to the compression mechanism and extends along a central axis of the shaft, and a degassing port that extends from an outer circumferential surface of the shaft to the oil supply channel between the compression mechanism and the oil separating member are formed in the shaft.

6. The compressor according to claim 1, wherein the motor has a rotor fixed to the shaft, and the oil separating member is fixed to the rotor.

7. The compressor according to claim 6, wherein the oil separating member further has an annular supporting portion that surrounds the bottom wall and continuously is provided to the bottom wall, the rotor includes a rotor core, a balance weight fixed to an end face of the rotor core, and a caulking member for caulk-fixing the balance weight to the rotor core, and the supporting portion is caulk-fixed, together with the balance weight, to the rotor core by the caulking member.

8. The compressor according to claim 1, wherein the oil separating member is located, relative to the motor, opposite to the compression mechanism, the motor has a rotor fixed to the shaft, and a plurality of rotor flow passages penetrating the rotor in the axial direction of the shaft are formed in the rotor, and the peripheral wall expands radially so that the working fluid discharged from the compression mechanism reaches the peripheral wall through the rotor flow passages and is guided outward by the peripheral wall.

9. The compressor according to claim 1, wherein the oil expelling ports are formed by punching the peripheral wall in a direction from the inner side of the peripheral wall to the outer side of the peripheral wall.

10. The compressor according to claim 1, wherein the oil separating member further has a flange portion extending radially outward from an end portion of the peripheral wall on a side opposite to the bottom wall.

11. The compressor according to claim 1, wherein the oil expelling ports are formed so that array circles in each of which the oil expelling ports are arrayed at an equiangular pitch are arranged in the axial direction of the shaft.

12. The compressor according to claim 1, wherein each of the oil expelling ports has an outer shape with a burr.

* * * * *